US007199336B2

(12) United States Patent
Wu

(10) Patent No.: US 7,199,336 B2
(45) Date of Patent: Apr. 3, 2007

(54) PROTECTION STRUCTURE OF CERAMIC RESISTOR HEATING MODULE

(76) Inventor: Chia-Hsiung Wu, P.O. Box No. 6-57, Junghe, Taipei 235 (TW)

( * ) Notice: Subject to any disclaimer, the term of this patent is extended or adjusted under 35 U.S.C. 154(b) by 225 days.

(21) Appl. No.: 10/952,825

(22) Filed: Sep. 30, 2004

(65) Prior Publication Data

US 2006/0087398 A1 Apr. 27, 2006

(51) Int. Cl.
*H05B 3/06* (2006.01)

(52) U.S. Cl. ..... 219/540; 219/553; 338/22 R

(58) Field of Classification Search ..... 219/202, 219/530, 538, 505, 540–542, 553; 338/22 R; 156/273.7

See application file for complete search history.

(56) References Cited

U.S. PATENT DOCUMENTS 4,414,052 A * 11/1983 Habata et al. ..... 156/273.7
6,259,075 B1 * 7/2001 Wu ..... 219/540
6,723,966 B2 * 4/2004 Jiang ..... 219/505
6,828,529 B1 * 12/2004 Wu ..... 219/540

* cited by examiner

*Primary Examiner*—Tu Hoang
(74) *Attorney, Agent, or Firm*—Troxell Law Office, PLLC

(57) ABSTRACT

A protection structure of a ceramic resistor heating module, and more particularly a protection structure of a heating module, which utilizes a ceramic resistor having a positive temperature coefficient and is consisted of cooling fins, includes insulation layers that are heat-insulated. Using the insulation layers, electricity and external hazardous substances such as acids, alkalis and salt are shielded to accomplish all-round protection.

6 Claims, 6 Drawing Sheets

PROTECTION STRUCTURE OF CERAMIC RESISTOR HEATING MODULE

BACKGROUND OF THE INVENTION (a) Field of the Invention

The invention relates to a protection structure of a ceramic resistor heating module, and more particularly, to a protection structure of a heating module that utilizes ceramic resistors having a positive temperature coefficient as heating elements thereof. The module comprises ceramic resistor heating elements, and dielectric plates and cooling fins at two sides thereof. Insulation layers are adopted to achieve all-round protection, thereby allowing the invention to be applied in hazardous environments.

(b) Description of the Prior Art

Referring to FIG. 1, a ceramic resistor heating module 1 comprises ceramic heating elements 2, and cooling fins 3 joined at outer sides of dielectric plates 4 and joining plates 40 at two sides.

Each the dielectric plate 4 has one end thereof formed with an electricity conducting terminal 41, and two ends thereof sealed by sealing covers 11 and 12. A clamp board 14 at assembled to each side of the module 1, with an elastic device 13 pressed and joined in between.

The assembly according to the aforesaid description is frequently used, wherein various members including the ceramic heating elements 2 and the dielectric plates 4, the joining plates 40 and the cooling fins, are pressed and clamped using the elastic devices 13 and the clamp plates 14 from outer sides, followed by sealing using the sealing covers 11 and 12, thereby forming a heating device.

Referring to FIG. 2 showing the prior heat dissipating module in another type of assembly, the heating elements 2 are similarly used, and the dielectric plates 4 are laterally disposed to join with the cooling fins 3.

Referring to FIG. 3, adhesive 5 is applied between the cooling fin 3 and the dielectric plate 4 to assemble the structure. Similarly, the heating elements 2 are also assembled using adhesion means to further form a heat dissipating module.

Referring to FIG. 4 showing another type of assembly means, fundamental parts are used to assemble the dielectric plate 4 and the cooling fin 3 through welding means, and then the dielectric plate 4 and the heating element 2 are joined using any methods.

Referring to FIG. 5 showing the aforesaid welding method, between a lower side of the cooling fin 3 and one side of the dielectric plate 4, a welding point 6 is set for welding to assemble the cooling fin 3 with the dielectric plate 4.

Similarly, the heating element 2 is assembled with the dielectric plate 4 using any methods.

Apart from heat conducting effects by discharging heat energy of the heating element 2 to an exterior, the cooling fins 3 and the dielectric plates 4 are more targeted at conducting electricity. Referring to FIG. 1, the electricity conducting terminal 41 conducts electricity and provides the heating element 2 with electricity by conducting through a side of the heating element 2.

Besides the aforesaid assembly means as mechanical and elastic pressing or fastening as shown in FIG. 1, assembly is also accomplished by welding as shown in FIG. 5.

However, the heating modules formed according to the aforesaid assembly methods are incapable of withstanding wash tests by salty water. Salty water tests are for testing endurance of the heating modules against salt, acids and alkalis The purpose of the above tests commonly used by the industrialists is to offer the heating elements with optimal physical property endurance and environment condition endurance when applied outdoors, especially when applied to automobile heating systems, so as to avoid loosening and deterioration. In the test, a liquid containing 5% of salt is used to continuously wash the heating module.

The aforesaid assembly methods includes a method used by German DBK Corporation to produce heating modules, which are tested by undergoing wash using water containing 5% of salt for 120 hours. The test results show that the heating modules fail to perform normal functions and become incapable of producing heat although overall structures of the heating modules remain intact. Heating modules assembled by adhesion, after undergoing wash tests with water containing 5% of salt for 120 hours, have loosening parts, with short circuits and sparkles resulted during the process. Therefore, for safety reasons, it is essential that the heating module be provided with an all-round protection structure, which is resistant against acids and alkalis or salt, so as to further insulate organic matters such as carbon monoxides or hydrogen oxides contained in moistures or air.

SUMMARY OF THE INVENTION

The object of the invention is to provide an all-round protection structure formed by equally thick membrane-like insulation layers at surfaces of various elements of a heating module. Using thorough coverage of the membrane-like insulation layers on the various elements, all-round resistant strength is produced against physical properties and environmental condition changes, thereby achieving reliable heat operations as well as offering usage safety.

DETAILED DESCRIPTION OF THE PREFERRED EMBODIMENTS

Figure 1:
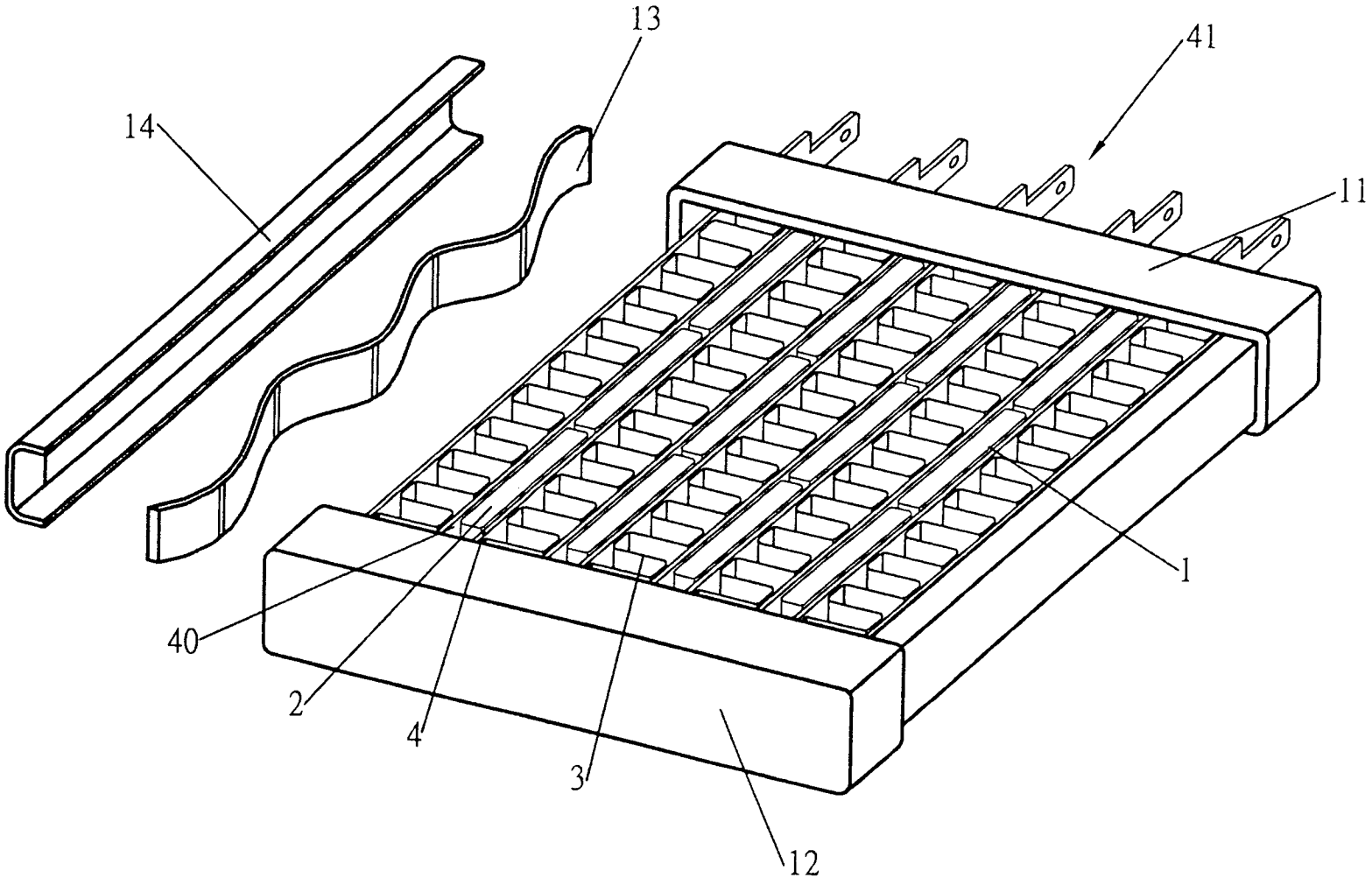
FIG.1 Prior Art
FIG. 1 shows a schematic view of an assembly according to a prior heating module.
Figure 2:
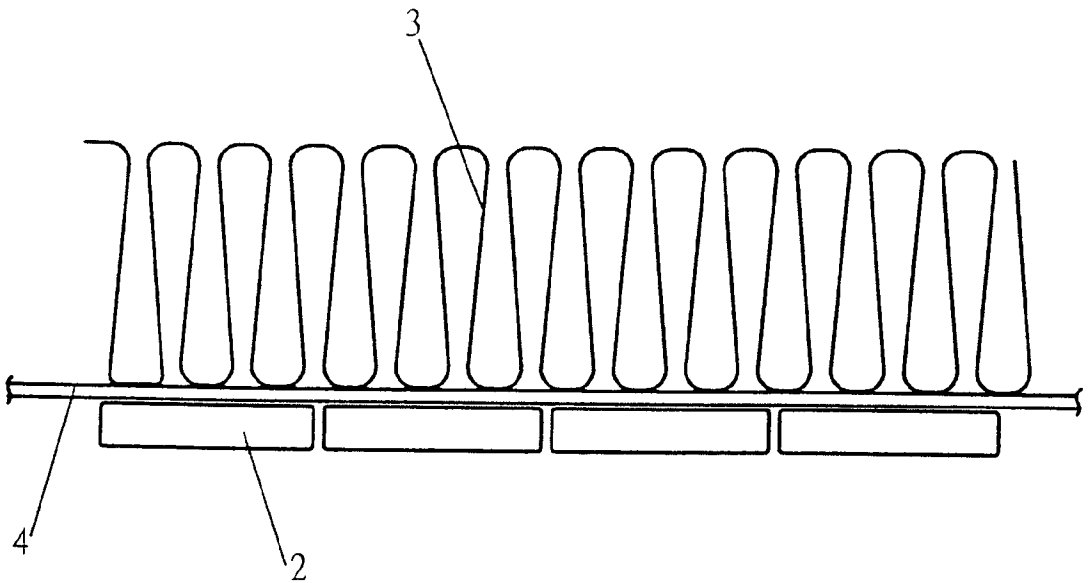
FIG.2 Prior Art
FIG. 2 shows a first schematic view illustrating an assembly relationship of a prior heating module.
Figure 3:
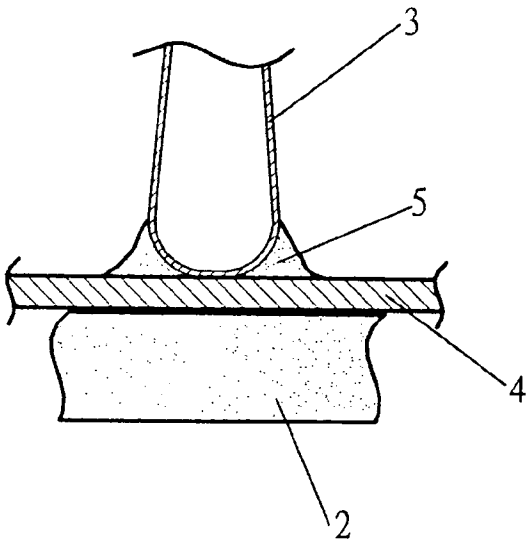
FIG.3 Prior Art
FIG. 3 shows a schematic view illustrating adhesion and joining of a prior heating module.
Figure 5:
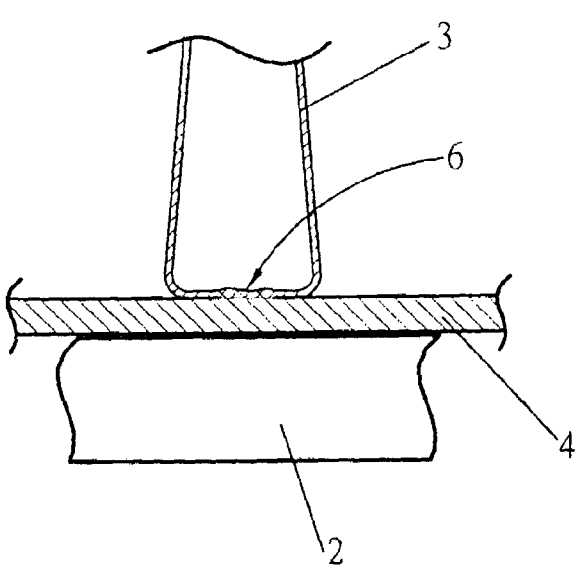
FIG.5 Prior Art
FIG. 5 shows a schematic view illustrating an assembly relationship using welding means of a prior heating module.
Figure 4:
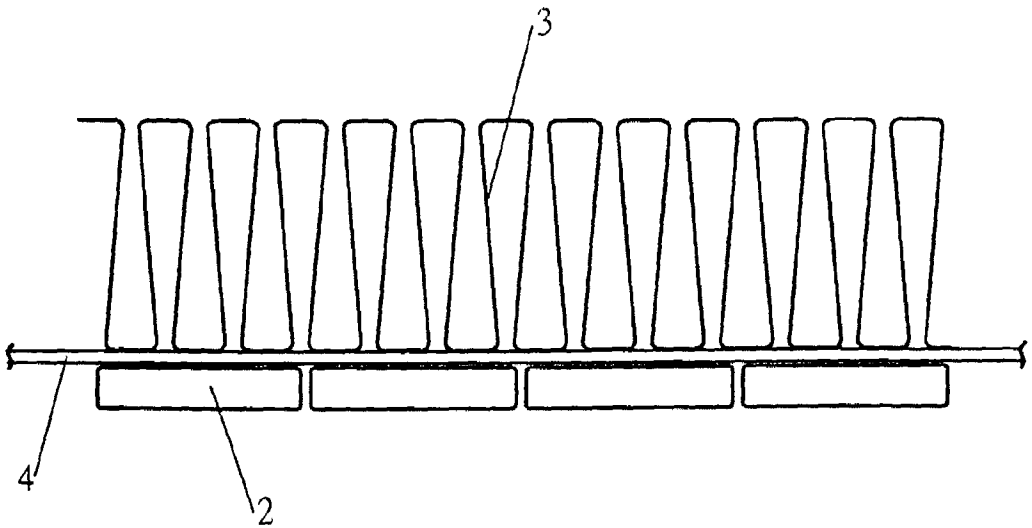
FIG.4 Prior Art
FIG. 4 shows a second schematic view illustrating an assembly relationship of a prior heating module.
Figure 6:
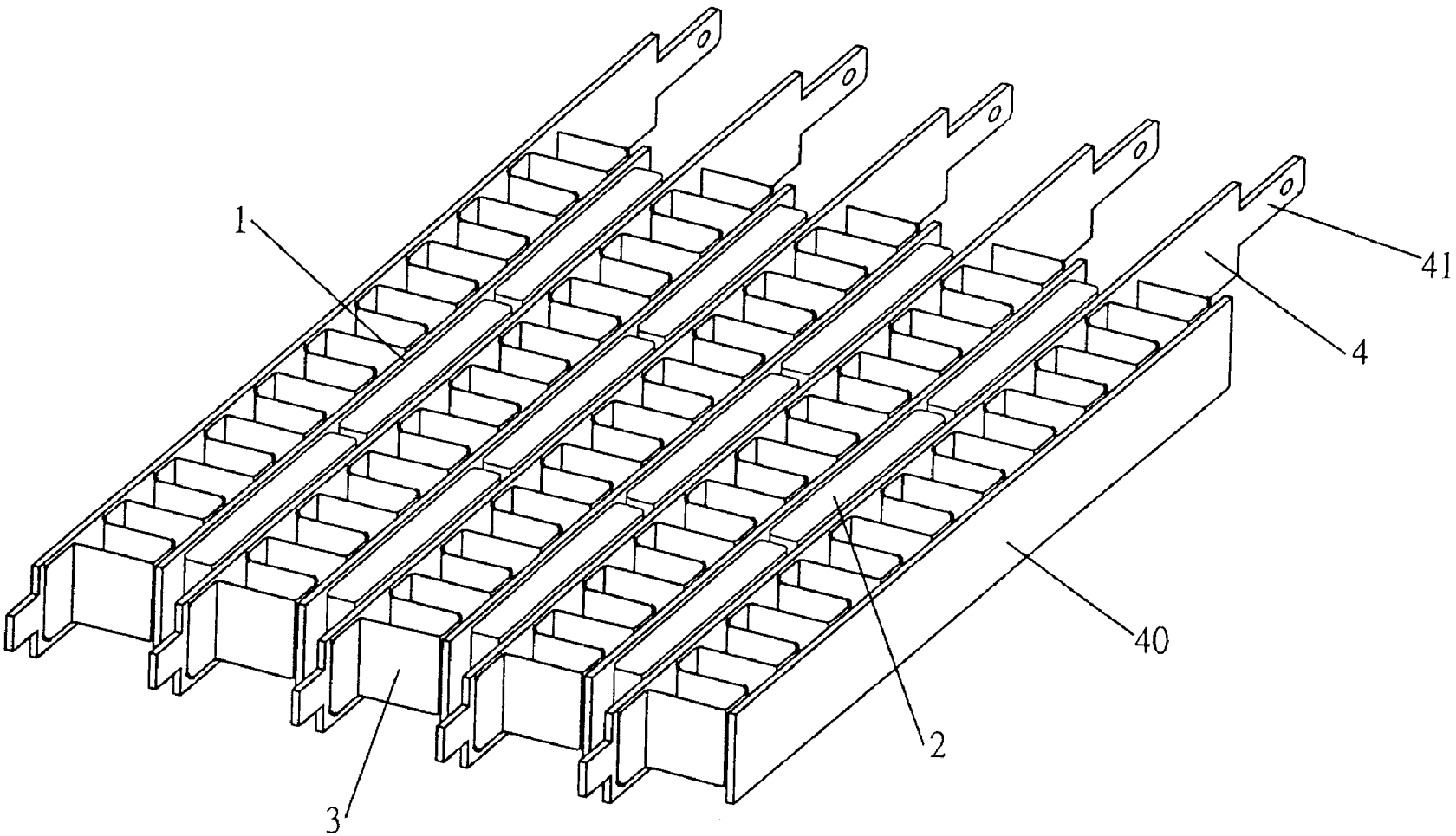
FIG. 6 shows a schematic view illustrating the main structure according to the invention.
Figure 7:
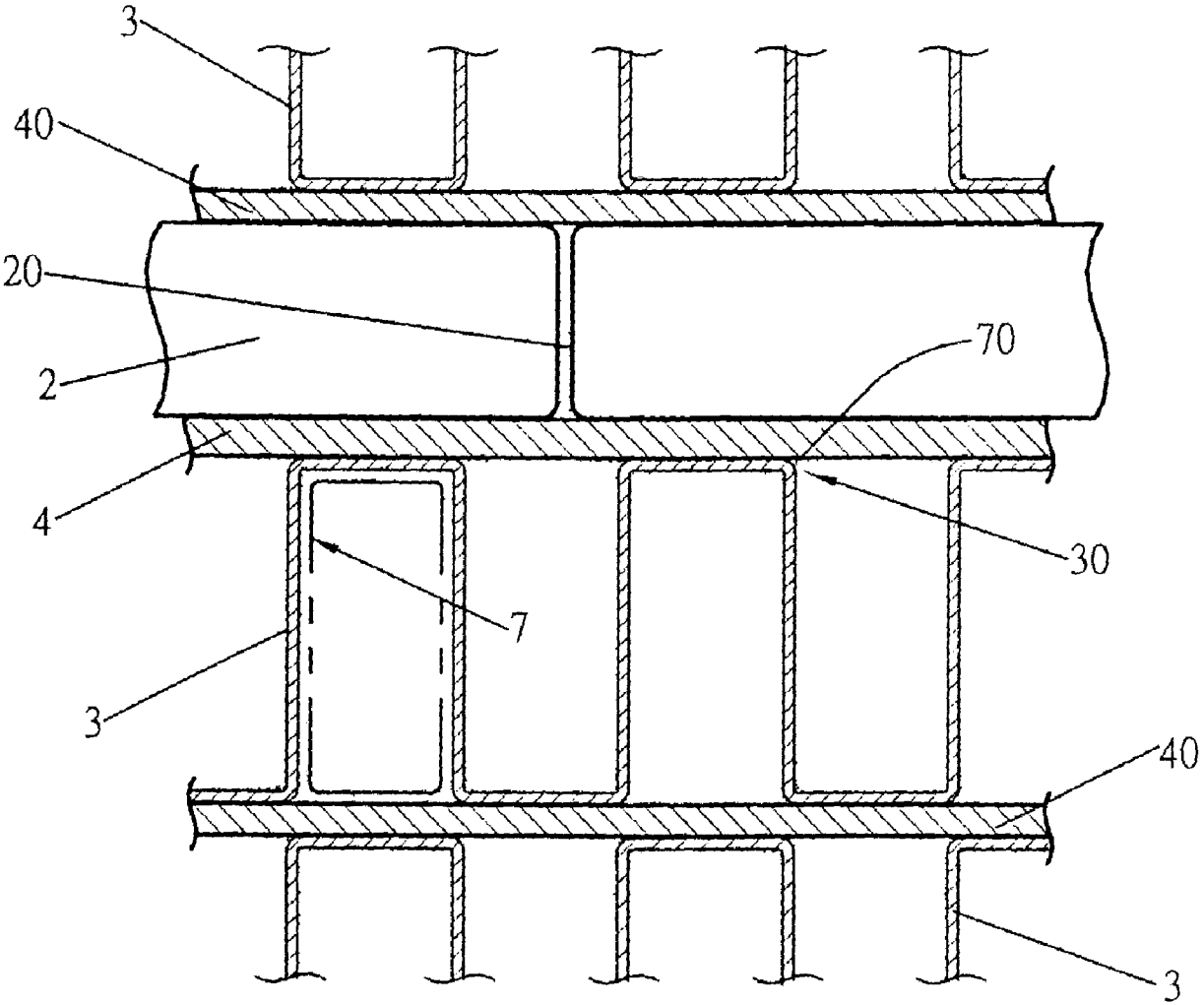
FIG. 7 shows a schematic view illustrating distribution of the insulation layers according to the invention.

Referring to FIG. 6, the invention similarly comprises heating elements 2, and cooling fins 3 joined at outer sides of dielectric plates 4 and joining plates 40 at two sides of each the ceramic heating element 2, thereby forming a heating module 1 having alternating electric conditions. Apart from electricity conducting terminals 41, breadths of the heating module 1 are disposed with insulation layers 7 by complete soaking means as shown in FIG. 7. The insulation layers 7 are formed by soaking means, and therefore relative gaps 20 between various elements like the heating elements 2, or adjoining corners 30 of the cooling fins 3 and the dielectric plates 4, are completely distributed with the insulation layers 7. The insulation layers 7 can be made from solvents using Teflon or silicon as a base material thereof. After being processed by soaking means, the solvents are evenly covered at the various elements according evenness of adhesion forces thereof. For instance, outer surfaces of the heating elements 2, the dielectric plates 4 and the cooling fins 3, are all formed with effective insulations layers 7 after solidification of the solvents.

In an embodiment according to the invention, the insulation layers 7 have even thicknesses, and can form fillings at the gaps 20 and at any clamping corners. Owing to intrinsic coherent forces and adjacent adhesion forces, more materials of the insulation layers are accumulated to further form fillings and mechanical reinforcements. In addition, using adhesive forces of the insulation layers 7, even more enhanced adhesion effects between the cooling fins and the dielectric plates 4 are obtained.

Figure 8:
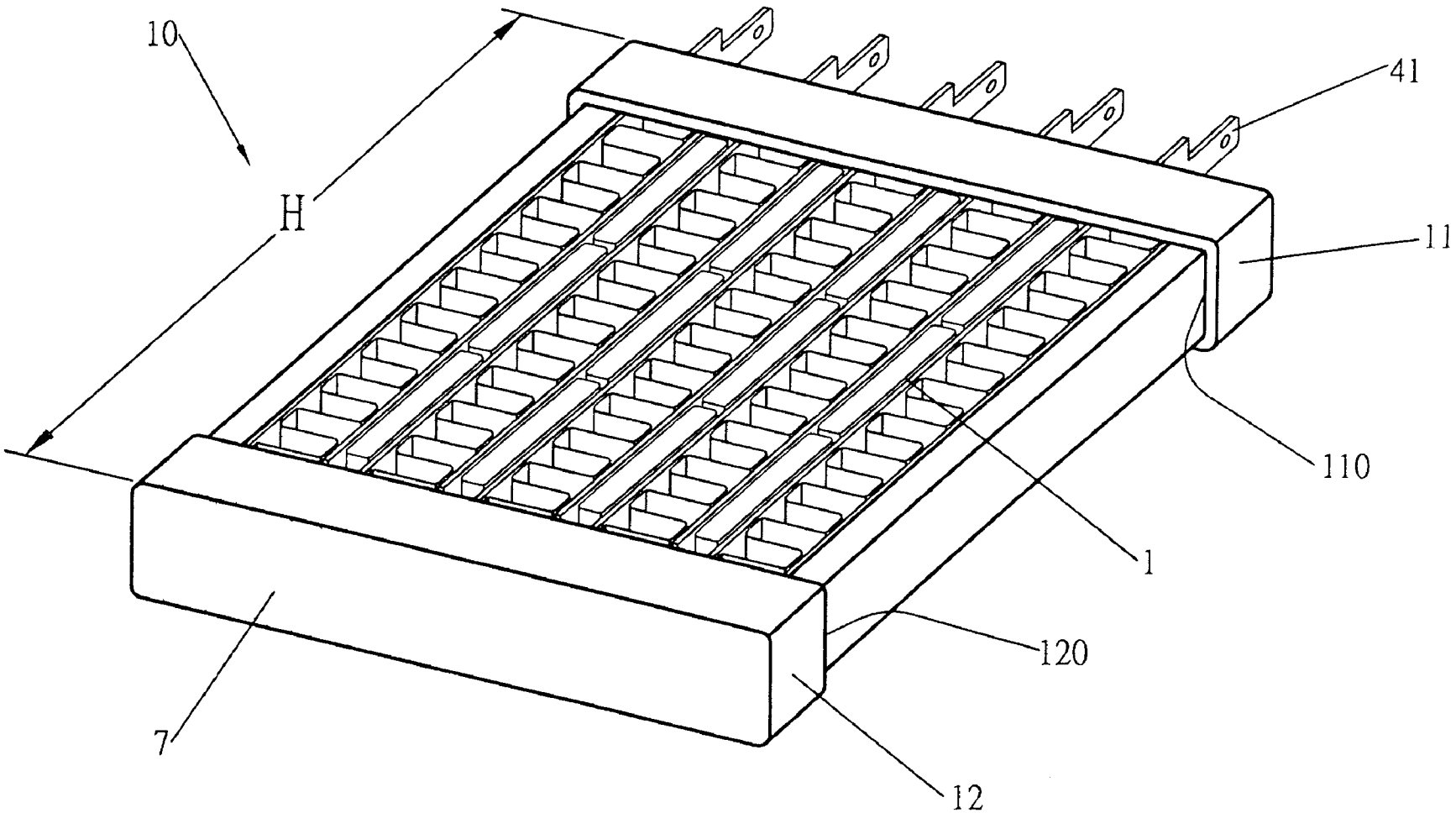
FIG. 8 shows another embodiment according to the invention.

Referring to FIG. 8, when having front and rear ends thereof sealed and assembled with the sealing covers 11 and 12, the module 1 according to the invention forms a heating device 10, wherein the terminals 41 can be conducted to electric terminals. The entire device 10 can then be distributed with the insulation layers 7 in an all-round manner. An entire height H including the sealing covers 11 and 12 are completely soaked in a material of the insulation layers 7, such that the insulation layers 7 are attached to surfaces of the entire structure. The entire heating device 10 formed according to this embodiment can be applied to operations having conditions of high humidity and even to operations in liquids.

The entire heating device 10 formed by sealing the sealing covers 11 and 12 can further have the sealing covers 11 and 12 be repeated with distribution of the insulation layers 7, such that gaps 110 and 120 between the sealing covers 11 and 12 and the module 1 are completely filled, thereby effectively and thoroughly shielding against moistures and preventing short circuits at gaps between the various elements.

The distribution of the reinforced insulation layers at the sealing covers 11 and 12 leaves main thermal operation surfaces of the heat dissipating module 1 unaffected, and thereof performance and efficiency of the heat dissipating surfaces consequently remain unaffected as well.

A material 70 forming the insulation layers 7 in the embodiment according to the invention can be added with materials such as magnesium oxides having higher heat conductance coefficient to increase heat conductivity thereof.

According to the invention, the insulation layers 7 are evenly distributed at surfaces of the various elements using soaking means. Through adhesive forces of the material 70 and atmospheric pressures, the insulation layers 7 formed at the surfaces of the various elements of the invention are allowed with even thicknesses, and hence uniform heat conduction efficiency is acquired.

Before solidifying during the soaking process, the module can be tumbled to cancel out dripping effects incurred by gravity to further ensure even thicknesses of the layers.

According to the embodiment of the invention, the insulation layers 7 are in fact membrane-like forms with extremely small thicknesses, which impose insignificant influence upon thermal conduction. Furthermore, the layers add a minute increase to an overall weight as well as to assembly dimensions without directly affecting assembly relationships.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A protection structure of a ceramic resistor heating module comprising:

a) a plurality of heating modules having alternating electric conditions, each of the plurality of heating modules having:

I) a plurality of ceramic heating elements;

ii) a plurality of cooling fins, the plurality of ceramic heating elements are alternatingly positioned between the plurality of cooling fins;

iii) a joining plate located on a first side of the plurality of cooling fins; and iv) a dielectric plate having a main body and an electricity conducting terminal located at one end of the main body, the main body of the dielectric plate is located on a second side of the plurality of cooling fins; and b) insulation layers coating surfaces of the plurality of ceramic heating elements, the plurality of cooling fins, the dielectric plate, and the main body of the dielectric plate.

2. The protection structure of a ceramic resistor heating module according to claim 1, wherein the insulation layers are made of polytetrafluroethylene as a base material thereof.

3. The protection structure of a ceramic resistor heating module according to claim 1, wherein the insulation layers are made of silicon as a base material thereof.

4. The protection structure of a ceramic resistor heating module according to claim 1, wherein the base material of the insulation layers is added with a heat conducting material having a higher heat conductance coefficient.

5. The protection structure of a ceramic resistor heating module according to claim 1, further comprising a front sealing cover covering a first end of the plurality of heating modules and a rear sealing cover covering a second end of the plurality of heating modules, the insulation layers coating the front sealing cover and the rear sealing cover.

6. The protection structure of a ceramic resistor heating module according to claim 5, wherein the front sealing cover and the rear sealing cover are reinforced with two coats of insulation layers.

* * * * *